US012258203B1

(12) United States Patent
Gallegos Ramirez et al.

(10) Patent No.: US 12,258,203 B1
(45) Date of Patent: Mar. 25, 2025

(54) COMBINATION SEMI-CLOSED WINGED TRAY AND SLEEVE FOR PACKAGING AND DISPLAYING FOOD ARTICLES

(71) Applicant: Tekni-Plex, Inc., Wayne, PA (US)

(72) Inventors: Julieta Elizabeth Gallegos Ramirez, Nuevo León (MX); Tomas Gerardo Garcia Flores, Nuevo León (MX); Manuel Lopez Navarro, Nuevo León (MX); Israel Fuentes Garza, Nuevo León (MX); Rodolfo Haenni, Waxhaw, NC (US); Suzanne Wolter, Yskima, WA (US)

(73) Assignee: Tekni-Plex, Inc., Wayne, PA (US)

( * ) Notice: Subject to any disclaimer, the term of this patent is extended or adjusted under 35 U.S.C. 154(b) by 79 days.

(21) Appl. No.: 18/372,961

(22) Filed: Sep. 26, 2023

(51) Int. Cl.
*B65D 1/34* (2006.01)
*B65D 71/06* (2006.01)
*B65D 85/34* (2006.01)

(52) U.S. Cl.
CPC ..... *B65D 85/34* (2013.01); *B65D 71/063* (2013.01)

(58) Field of Classification Search
CPC ..... B65D 71/063; B65D 85/32; B65D 85/34; B65D 85/324
USPC ..... 206/521.1–521.8, 434, 557, 564, 565; 220/255, 508; 426/124
See application file for complete search history.

(56) References Cited

U.S. PATENT DOCUMENTS

| | | | | | |
|---|---|---|---|---|---|
| 2,466,579 | A * | 4/1949 | Cox | B65D 85/324 | 206/521.1 |
| 2,591,471 | A * | 4/1952 | Schwertfeger | B65D 85/324 | 206/521.1 |
| 3,362,606 | A * | 1/1968 | Trimble | B65D 85/324 | 206/521.1 |
| 3,568,915 | A * | 3/1971 | Newman | B65D 85/324 | 206/521.1 |
| 4,335,813 | A * | 6/1982 | Bessett | B65D 85/324 | 206/521.1 |
| 5,695,062 | A * | 12/1997 | Lemaire | B65D 43/22 | 206/521.1 |
| 5,866,181 | A * | 2/1999 | Hill | B65D 75/54 | 426/396 |
| 6,579,549 | B1 * | 6/2003 | Thrasher | A23L 13/75 | 426/399 |
| 2024/0383657 | A1 * | 11/2024 | Tai | B65D 85/34 | |

OTHER PUBLICATIONS

Prior Art #1—Prior Arrangement Design as shown (prior to Sep. 26, 2023, applicant's filing date).
Prior Art #2—Prior Arrangement Design as shown (prior to Sep. 26, 2023, applicant's filing date).

(Continued)

*Primary Examiner* — Luan K Bui
(74) *Attorney, Agent, or Firm* — POLSINELLI PC

(57) ABSTRACT

A semi-closed base tray of molded pulp material having cavities for holding individual food articles, such as apples, and a pair of opposing wings or flaps integral with the base tray and hingedly attached to opposing front and rear edges of the base tray, for partially enclosing the apples positioned in the base tray, in combination with an open-ended sleeve positionable over the base tray (when filled with the food articles) that serves to hold the wings in the closed position while allowing the fruit to be visible in the tray and sleeve combination.

13 Claims, 15 Drawing Sheets

(56) References Cited

OTHER PUBLICATIONS

Prior Art #3—Prior Arrangement Design as shown (prior to Sep. 26, 2023, applicant's filing date).
Prior Art #4—Prior Arrangement Design as shown (prior to Sep. 26, 2023, applicant's filing date).

* cited by examiner

COMBINATION SEMI-CLOSED WINGED TRAY AND SLEEVE FOR PACKAGING AND DISPLAYING FOOD ARTICLES

FIELD OF THE INVENTION

The present invention relates to food packaging, and more particularly to a semi-closed winged tray and sleeve for holding and displaying food articles, such as apples.

BACKGROUND OF THE INVENTION

Cartons for packaging fruit and other food articles are subjected to multiple adverse mechanical forces and environmental conditions during filling, handling and transport between distribution centers, store shelves and the ultimate consumer's home. They typically encounter automated equipment for filling, packaging, loading, unloading, stacking, restacking and transport. During each of the encounters, the goal is to resist bruising or breakage by stabilizing and holding the fruit in a protected environment, in a carton that can be manufacture in a cost-effective manner.

Thus, many factors are taken into consideration in the design of such cartons, Fruit protection, resistance to stress or force, stack-ability, transportability, moisture resistance, aesthetic appearance, print surface area for advertising and branding labels, weight, nestability/denestability, adaptability to accommodate various size fruit articles, and consistent manufacturing are factors which are all considered to varying degrees in the design of a fruit carton.

Most often, fruit is packaged in a cardboard box, which encloses a separate pulp base tray having multiple cavities for holding each article (apple or the like). The cardboard box is opened to display the fruit. Alternatively, a plastic wrapping surrounds the fruit and base tray, holding the fruit in position, but again such wrapped trays must be further protected in a box during transport and stacking.

Thus, there is a need for an improved food package to provide better protection while encountering adverse mechanical forces and environmental changes that typically occur during packaging, transportation and storage. There is also a need for a food package that is cost effective and allows viewing of the enclosed food article. There is also a need to provide a label area on the package that is visible when the food package is on display in the store. These and other advantages are addressed by the present invention.

SUMMARY OF THE INVENTION

The present invention is a combination semi-closed winged tray and outer sleeve for packaging and displaying food articles, such as apples.

The invention is directed to a semi-closed base tray of molded pulp material having cavities for holding individual food articles, such as apples, and a pair of opposing wings or flaps integral with the base tray and hingedly attached to opposing front and rear edges of the base tray, for partially enclosing the apples positioned in the base tray, in combination with an open-ended sleeve positionable over the base tray (when filled with the food articles) that serves to hold the wings in the closed position while allowing the fruit to be visible in the tray and sleeve combination.

In one or more embodiments, a combination base tray and outer sleeve are provided for packaging, viewing and labeling of individual food articles such as fruit (e.g., apples), wherein:

- the outer open-ended sleeve includes a relatively flat label area (when positioned over the base tray and fruit) for advertising or branding of the food product (e.g., apples);
- the wings or flaps protect and hold in place the individual fruit articles (apples), along with the outer sleeve;
- the wings or flaps give rigidity and support in stacking of multiple such filled base tray and sleeve combinations, for example when enclosed in a shipping container or on display in the store;
- when stacked, the winged tray supports the loads, with compression posts in both wings providing rigidity and strength, without buckling or crushing the fruit;
- the open top portion of the winged tray, in the closed position, permits viewing of the fruit enclosed in the winged tray and sleeve.

In one embodiment, there is provided a combination winged tray and outer sleeve for packaging and displaying a plurality of individual food articles, such as apples, comprising:

- the winged tray comprising an integral molded fiber article having a central base tray and a pair of opposing winged cover portions integral with and hingedly connected to opposing front and rear edges of the central base tray for pivoting between open and closed positions over the central base tray, the central base tray and winged cover portions each having a complimentary array of base cells and cover cells respectively that together form an array of semi-closed cell pockets for holding individual food articles in each semi-closed cell pocket when the winged cover portions are closed over the central base tray;
- each cell of the opposing winged cover portions having a closed outer wall portion adjacent one of the front and rear edges of the central base tray for partially covering a food article in one of the semi-closed cell pockets, and an open central portion that lies between the opposing winged cover portions in the closed position for displaying food articles in the semi-closed cell pockets,
- mating base and cover cell posts on the central base tray and winged cover portions respectively disposed adjacent the front and rear edges of the central base tray, and disposed between adjacent semi-closed cell pockets, for supporting the winged cover portions on the central base tray in the closed position, and
- the outer sleeve comprising an open-ended sleeve having a closed central loop portion configured to engage around a plurality of the semi-closed cell pockets for holding the winged cover portions on the central base tray in the closed position and for displaying the food articles in the semi-closed closed cell pockets.

In various embodiments,

- the front and rear edges of the base tray are disposed parallel to a longitudinal centerline of the winged tray, and the open central portion lies above the longitudinal centerline.

In various embodiments,

- transverse flanges are provided on the winged cover portions for holding the outer sleeve on the winged tray in the closed position.

In various embodiments,

- the outer sleeve is made of paper, pulp, plastic or cardboard material.

In various embodiments, the closed central loop portion of the sleeve has a flat label area configured to lie above the central base tray and winged cover portions in the closed position.

In various embodiments, the closed central loop portion of the sleeve has a length aligned with the longitudinal centerline configured to cover only a portion of the semi-closed cell pockets adjacent the front and rear edges.

In various embodiments, the central base tray and winged cover portions have opposing right and left side edges, extending between the front and rear edges.

In various embodiments, each base cell has an outwardly bowed sidewall portion sized to receive a major cell diameter of a food article disposed in the base cell.

In various embodiments, the sidewall portions of two adjacent base cells form a cell divider which prevents contact between food articles in the adjacent cells.

In various embodiments, the central base tray has a top wall that lies in a top reference plane TRP and defines an open top end of each base cell, and the base cell posts extend above the TRP.

In various embodiments, the cell posts of the base tray include front and rear edge base cell posts disposed adjacent the front and read edges respectively and each having an upper support wall disposed above the TRP, and the cell posts of the winged cover portions include front and rear edge cover cell posts disposed adjacent the front and rear edges respectively with mating surfaces for engaging the upper support wall of the front and rear edge base cell posts.

In various embodiments, the base tray includes a plurality of supporting posts disposed along the longitudinal centerline.

In various embodiments, the food articles comprise one or more of apples, oranges, grapefruits, guavas, kiwis, peaches, pears, Asian pears, avocados, tomatoes, lemons and limes.

These and other features of the present invention are disclosed in the following detailed description and accompanying drawings.

BRIEF DESCRIPTION OF THE DRAWINGS

For a better understanding of the invention, and to show how the same may be carried into effect, reference will now be made, by way of example to the accompanying drawings, in which.

DETAILED DESCRIPTION

Figure 1:
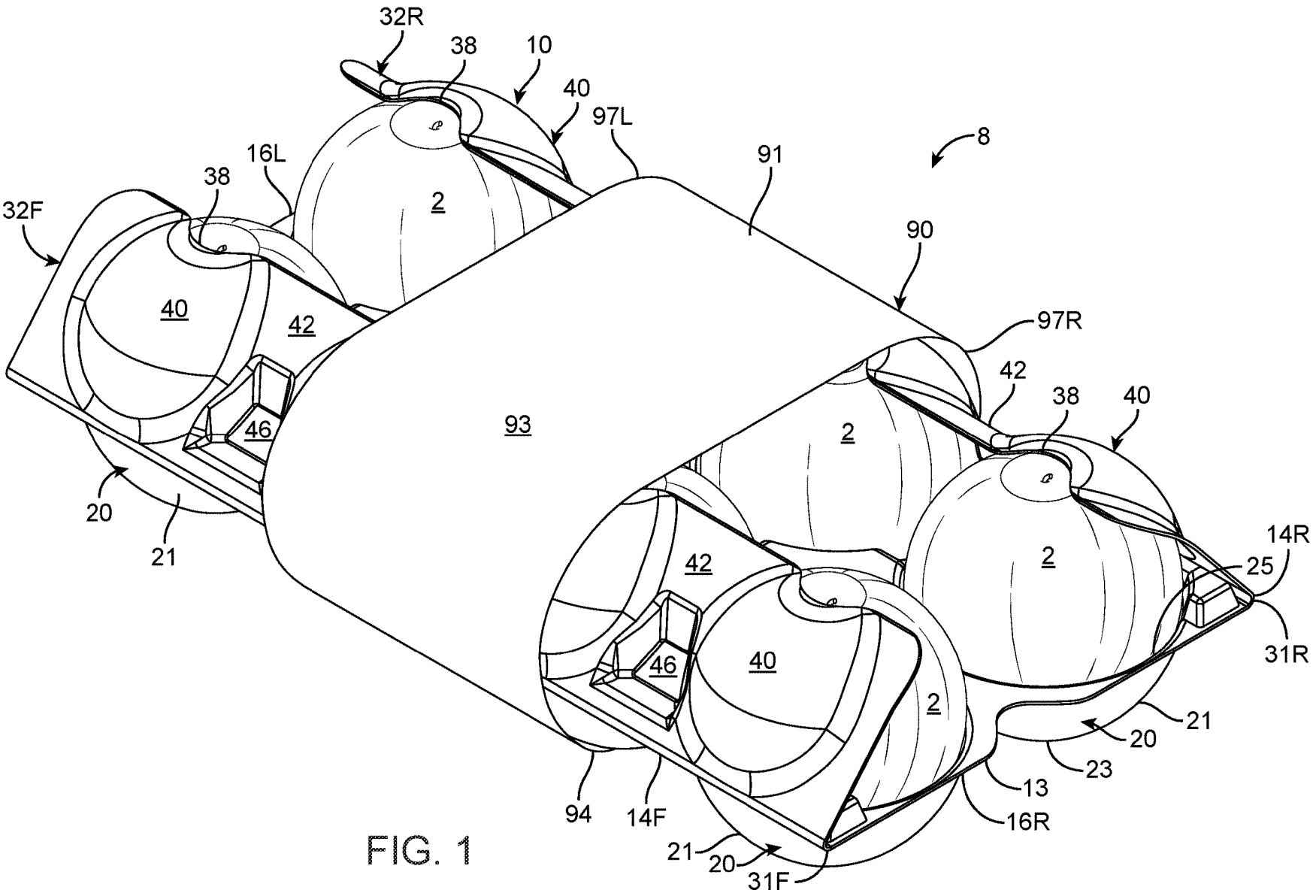
FIG. 1 is a top perspective view of a winged tray and sleeve according to one embodiment of the invention, showing the winged tray filled with 8 apples in the closed position and with the sleeve disposed over the filled, closed tray.

Referring generally to the Figures, a combination packaging system 8, including a winged base tray 10 and outer sleeve 90, is shown which is illustrative of the inventive features disclosed herein. The embodiment of FIGS. 1-14 is configured to hold eight (8) apples in individual cell pockets for both transport and display. The teachings of this disclosure may be applied to forming different sized and shaped combination packaging systems, such as six (6) or four (4) cell pockets, in a rectangular or square packaging configuration. For example, the system may be configured to hold and display various individual food articles each in a separate cell pocket, and more particularly generally round or oval shaped fruit articles such as apples, oranges, grapefruits, guavas, kiwis, peaches, pears, Asian pears, avocados, tomatoes, lemons, limes, and the like. The packaging dimensions, and pulp tray thickness can be designed to accommodate the individual fruit articles as appropriate.

Figure 2:
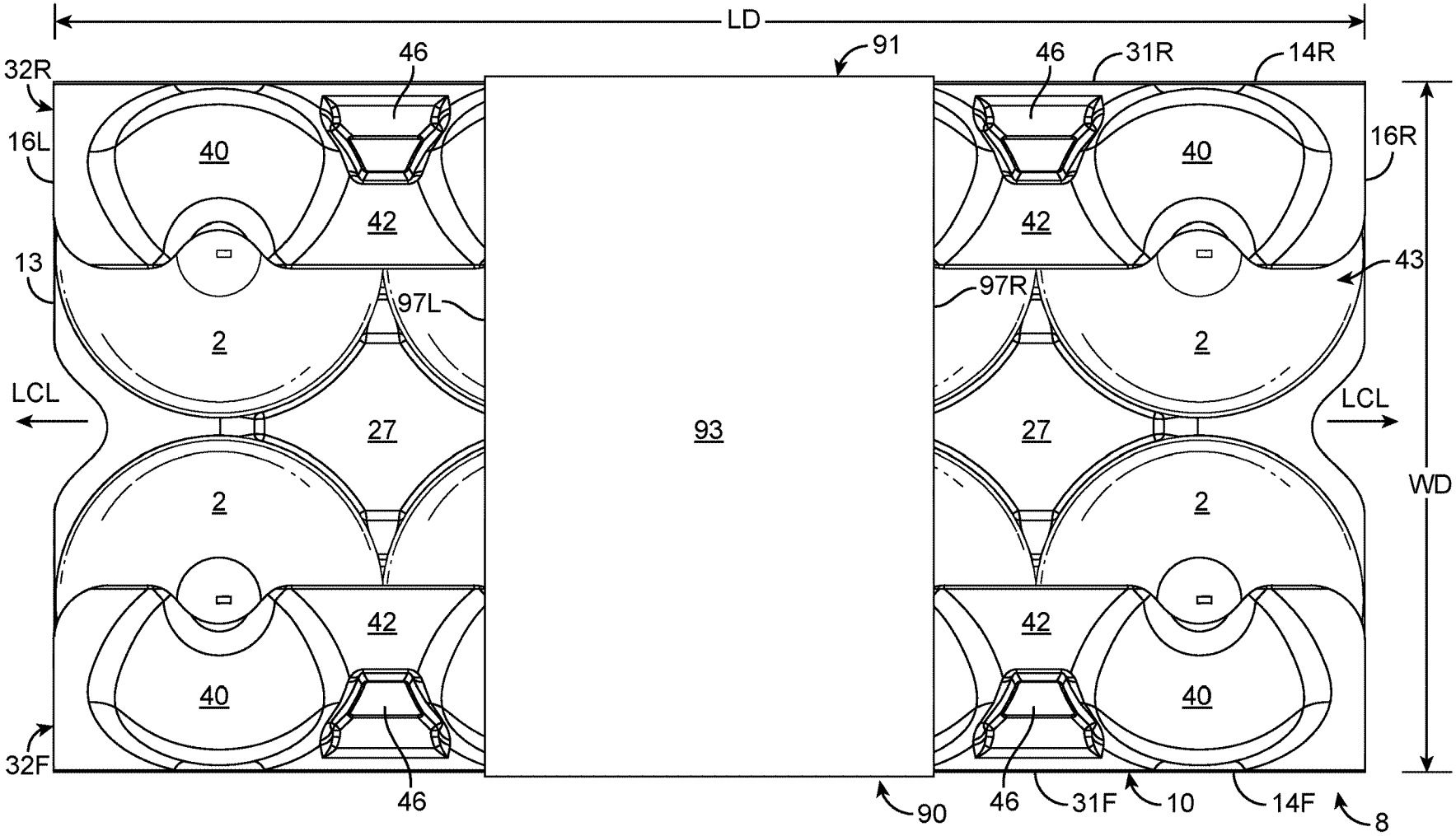
FIG. 2 is a top plan view of the embodiment of FIG. 1, in the same configuration.
Figure 3:
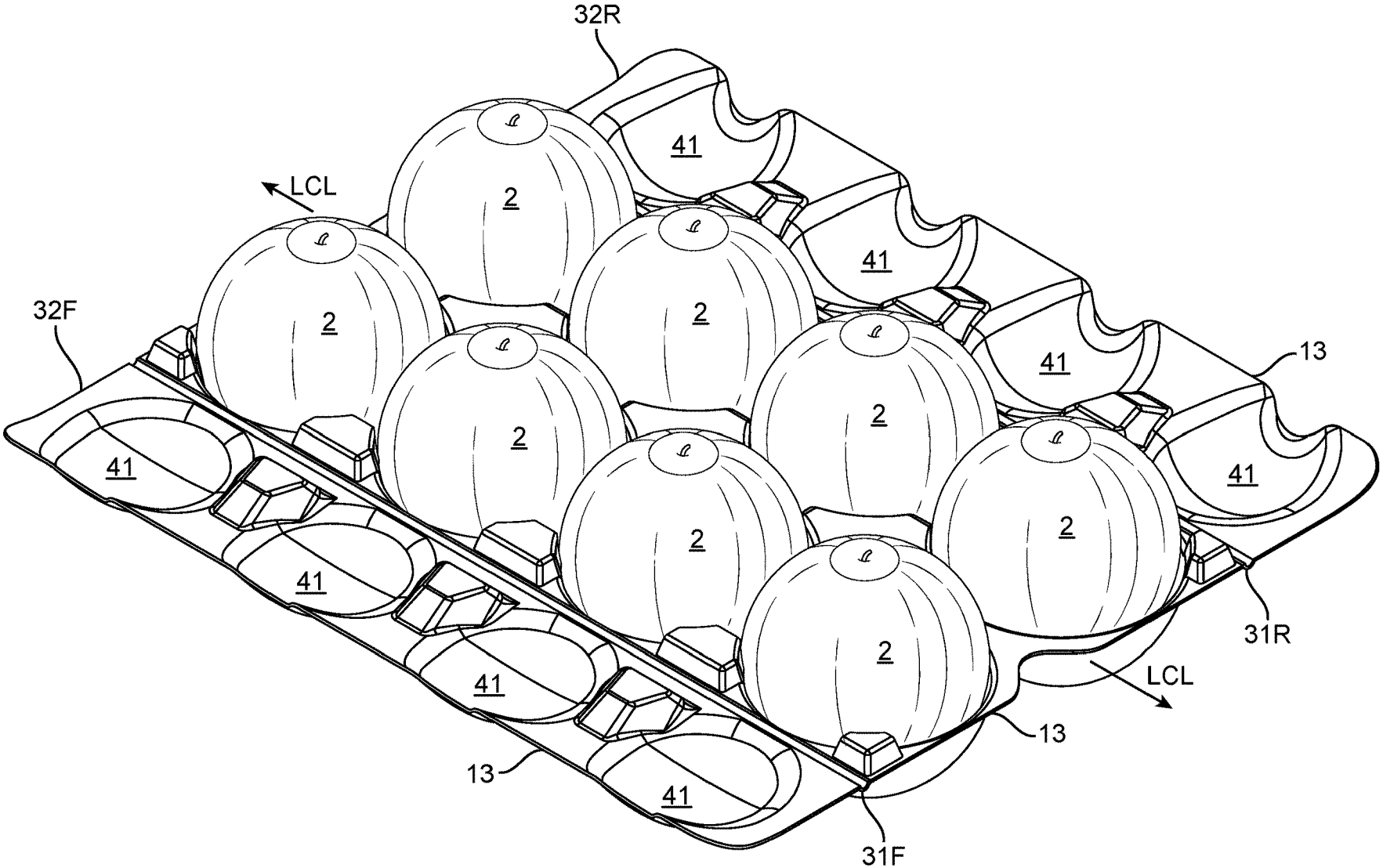
FIG. 3 is a top perspective view of the embodiment of FIG. 1, with the filled tray in the open position and without the sleeve.
Figure 4:
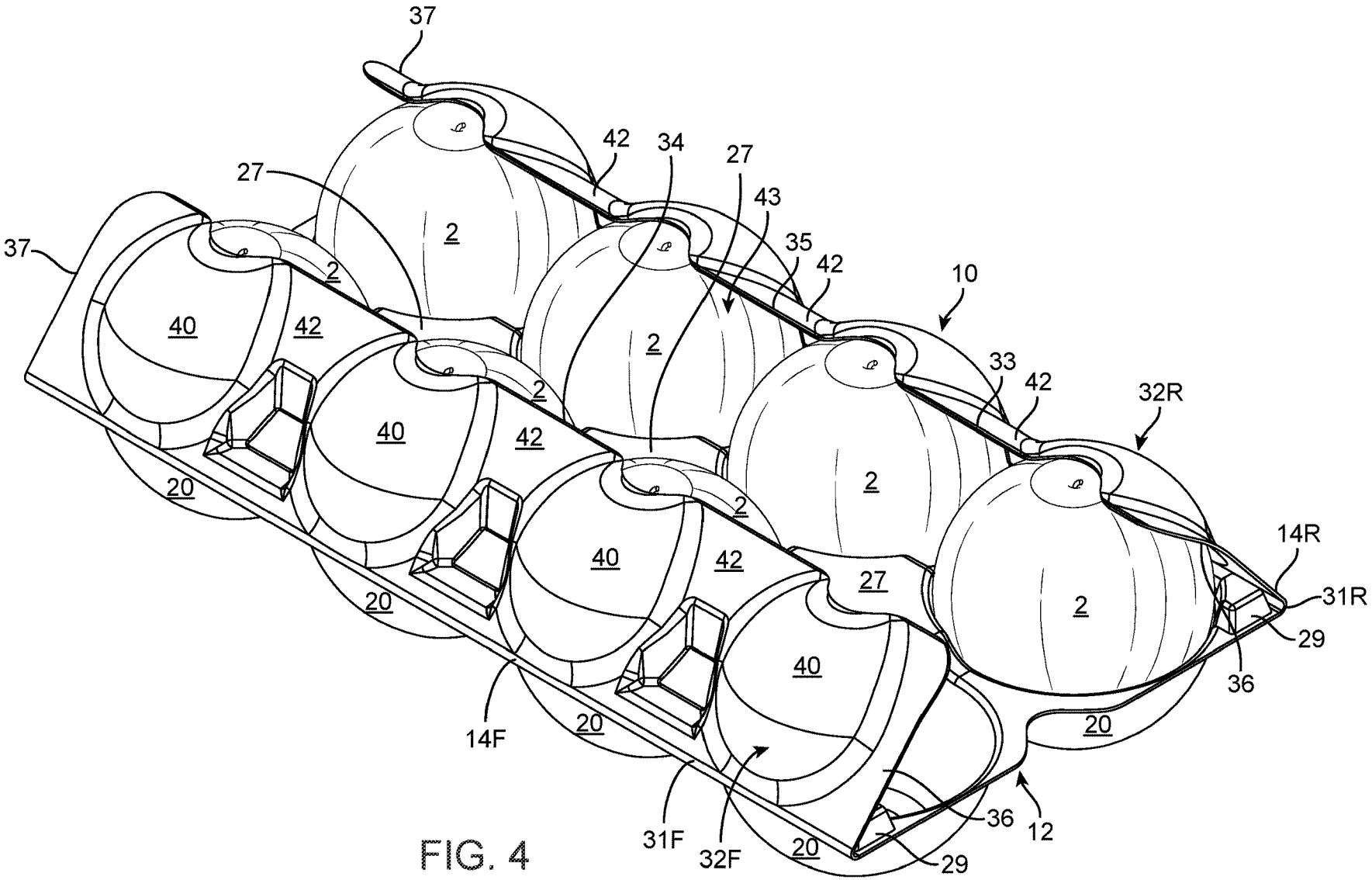
FIG. 4 is a top perspective view of the embodiment of FIG. 1, with the filled tray in the closed position and without the sleeve.
Figure 5:
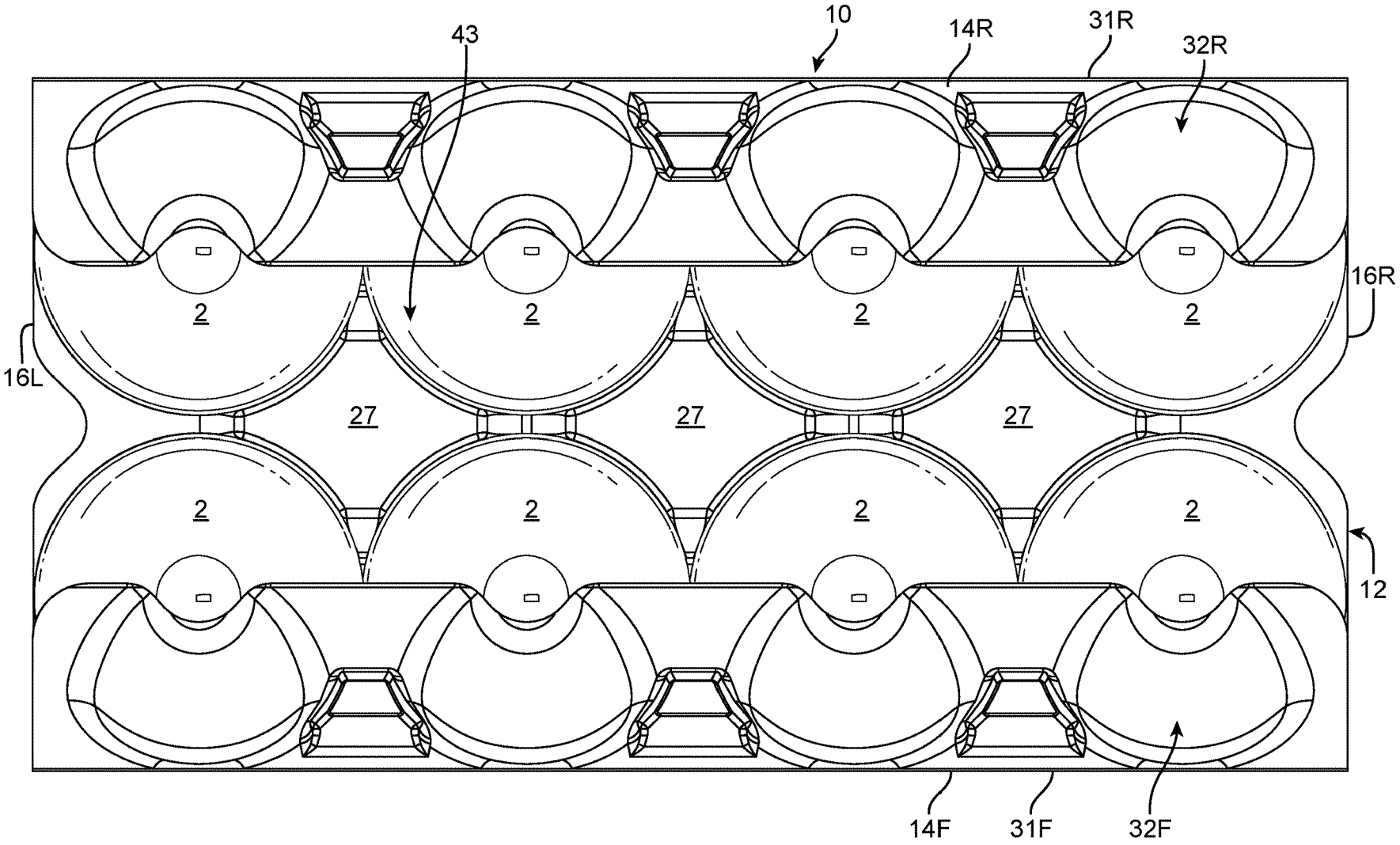
FIG. 5 is a top plan view of the embodiment of FIG. 1, with the filled tray in the closed position and without the sleeve.
Figure 6:
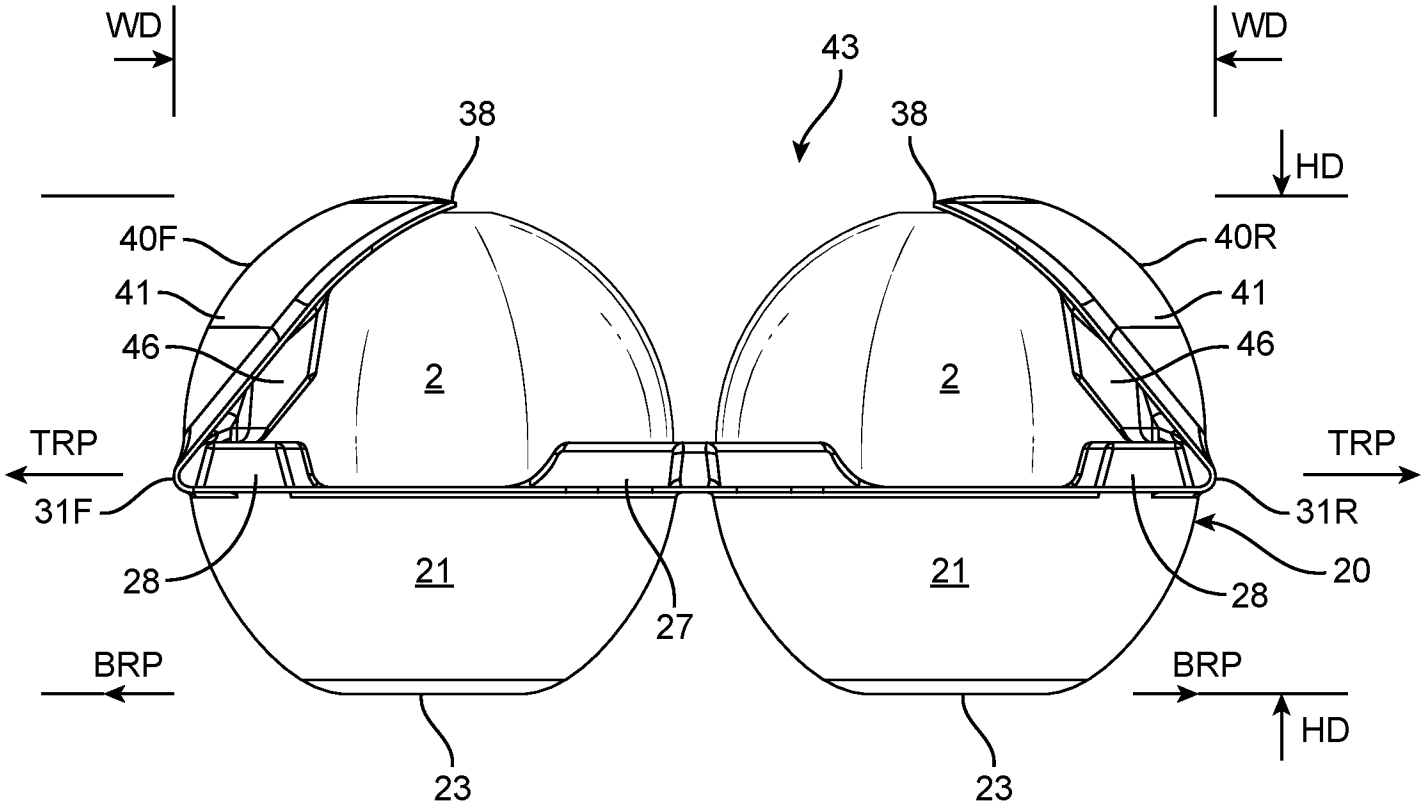
FIG. 6 is an end plan view of the embodiment of FIG. 1, with the filled tray in the closed position and without the sleeve.
Figure 9:
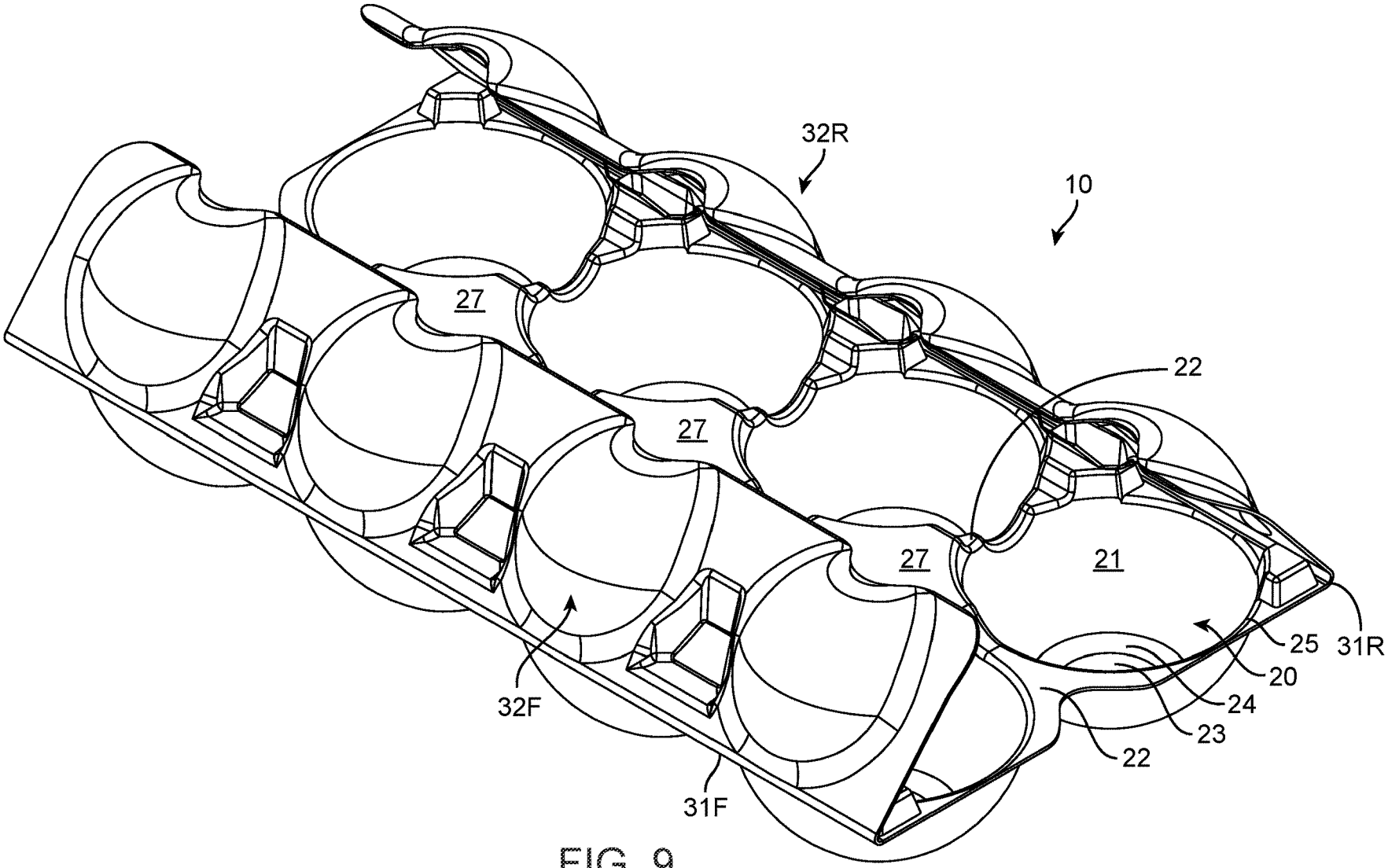
FIG. 9 is a top perspective view of the embodiment of FIG. 1, with tray unfilled in the closed position and without the sleeve.
Figure 10:
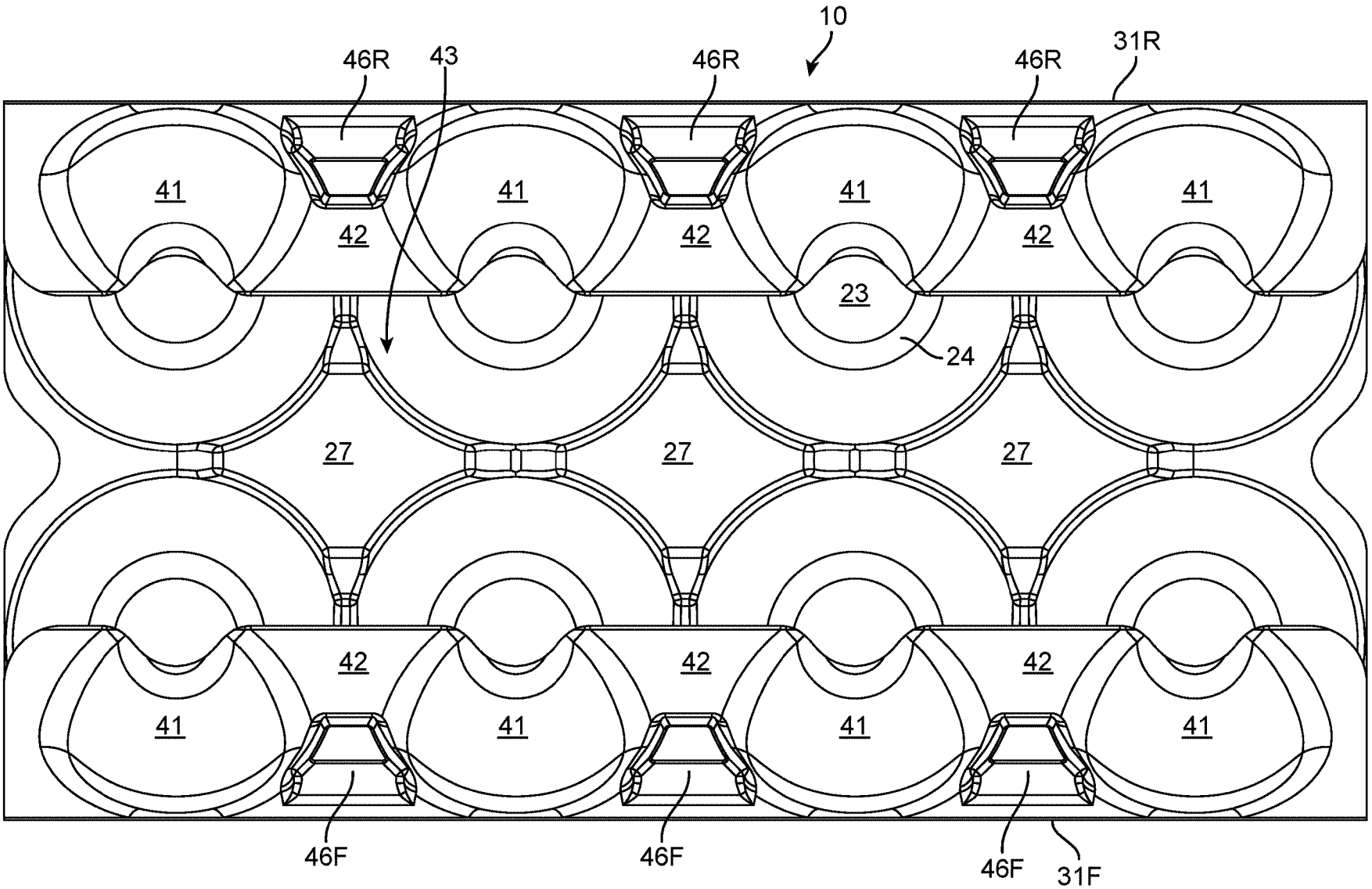
FIG. 10 is a top plan view of the embodiment of FIG. 1, with tray unfilled in the open closed and without the sleeve.
Figure 11:
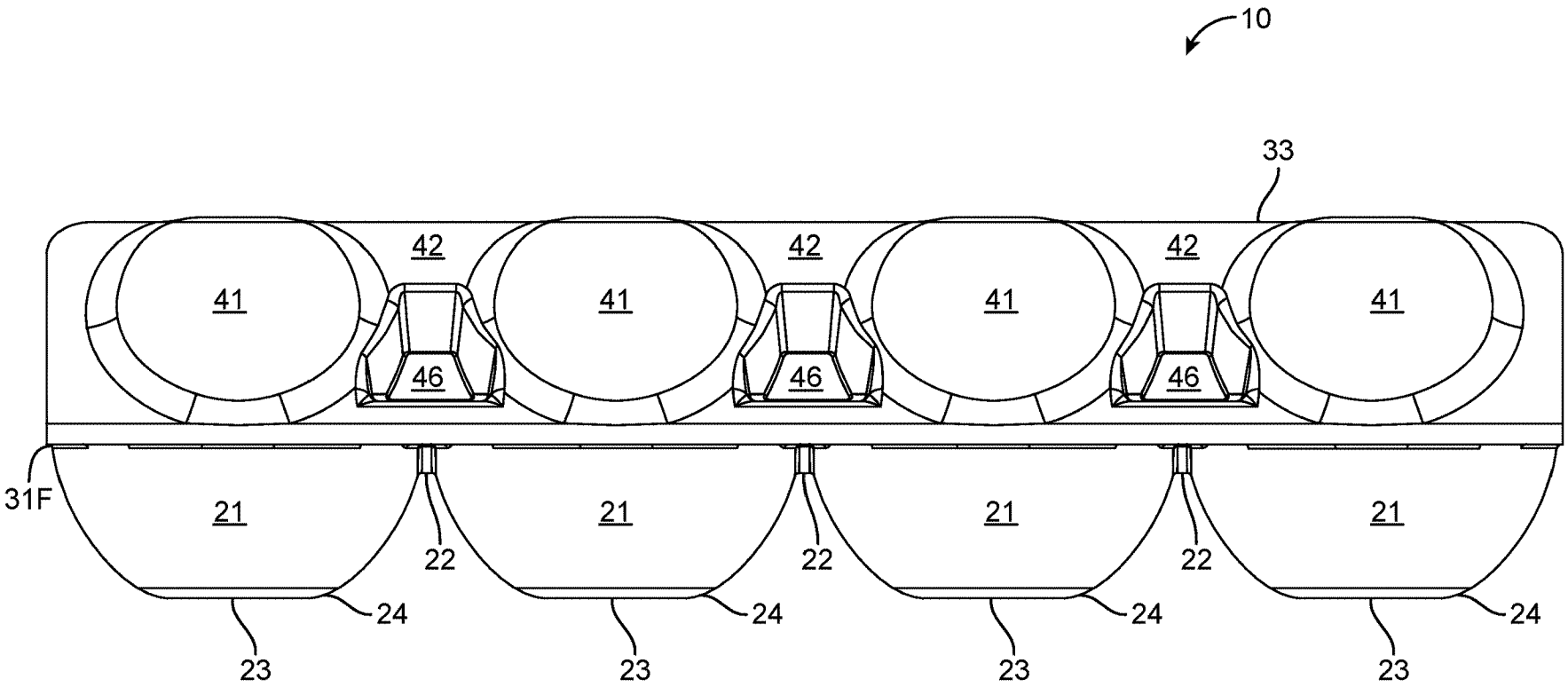
FIG. 11 is a front plan view of the embodiment of FIG. 1, with tray unfilled in the closed position and without the sleeve.
Figure 12:
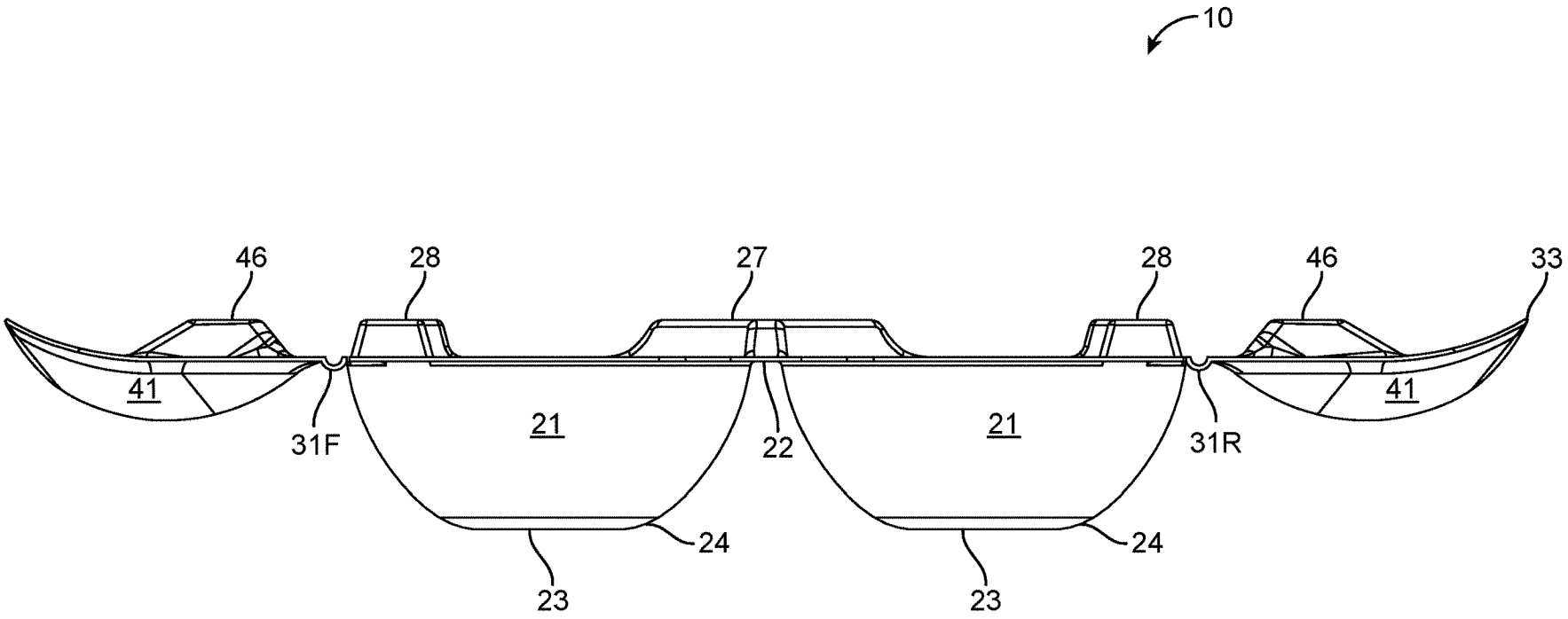
FIG. 12 is an end plan view of the embodiment of FIG. 1, with tray unfilled in the open position and without the sleeve.
Figure 13:
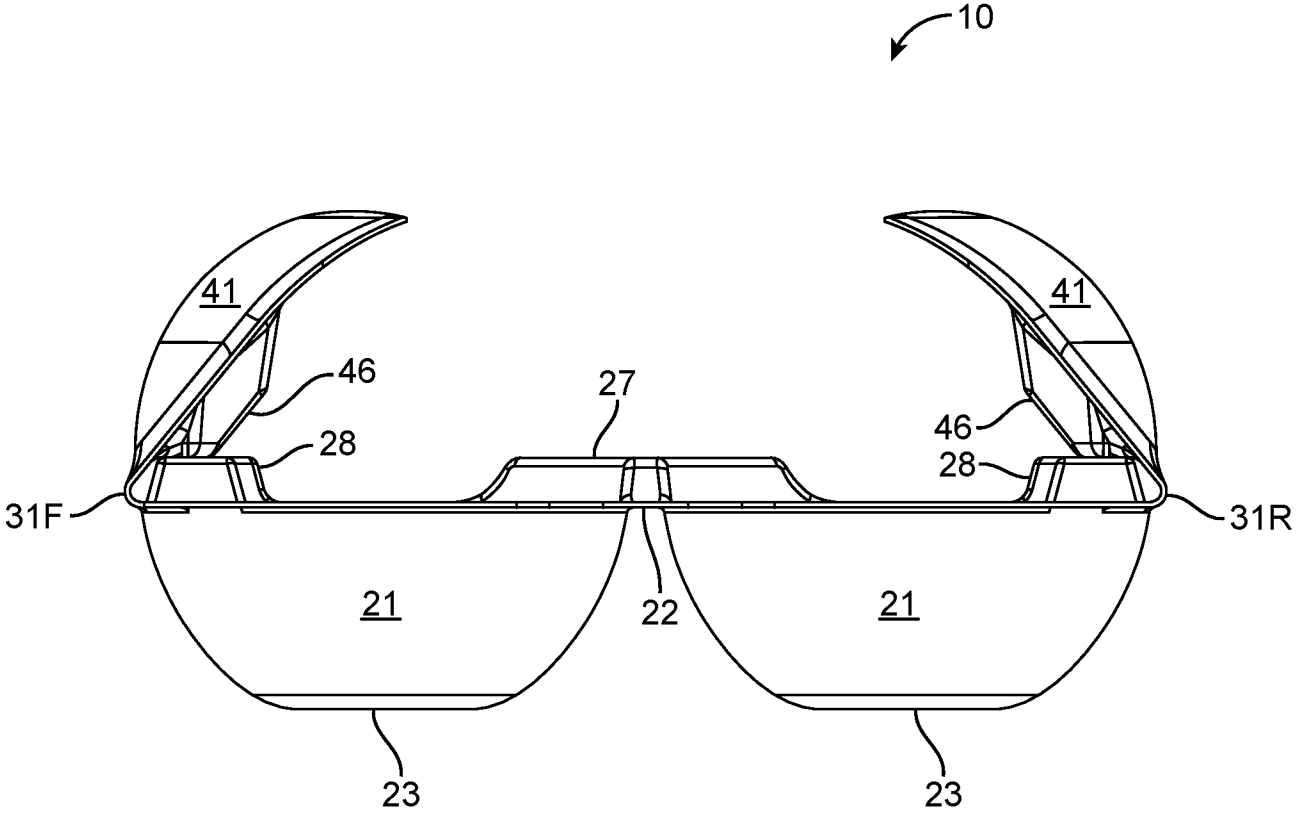
FIG. 13 is an end plan view of the embodiment of FIG. 1, with tray unfilled in the closed position and without the sleeve.
Figure 14:
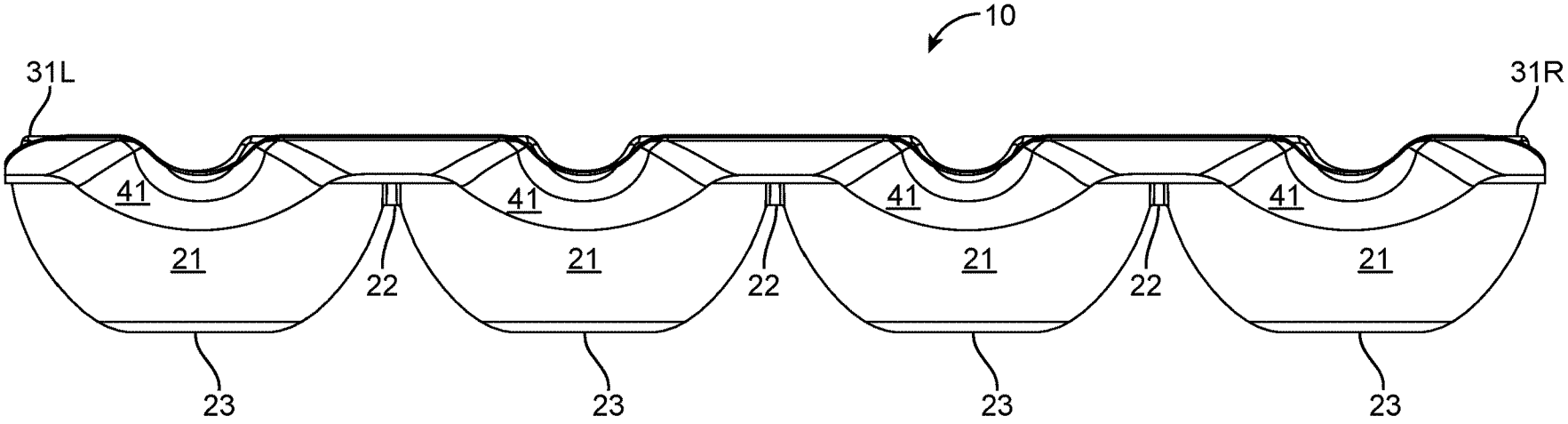
FIG. 14 is a front plan view of the embodiment of FIG. 1, with tray unfilled in the open position and without the sleeve.

The figures are grouped as follows for illustrative purposes:

FIGS. 1-2 show the combination of a winged base tray filled with apples, in the closed position, and with an outer sleeve thereover;

FIG. 3 shows the winged base tray filled with apples, in the open position, without the outer sleeve;

FIGS. 4-6 show the winged base tray filled with apples, in the closed position, without the outer sleeve;

FIGS. 7-8, 10, 12 and 14 show the winged base tray unfilled (without apples), in the open position, without the outer sleeve;

FIGS. 9, 11 and 13 show the winged base tray unfilled (without apples), in the closed position, without the outer sleeve.

The combination packaging system 8, including the winged tray 10 and outer sleeve 90 disposed in a closed position (see FIGS. 1-2), is generally rectilinear in configuration with a length L extending between left and right side perimeter edges 16L and 16R in the length-wise direction LD, and width W extending between front and rear side perimeter edges 14F and 14R in the width-wise direction WD, and a height H extending in a height-wise direction (transverse to L and D) between a base reference plane BRP in which a bottom wall 23 of the base tray resides and a top reference plane TRP in which open top edges 38 of the wings or flaps 32 of the winged base tray reside in the open position. The outer sleeve 90 has opposed open left and right-side edges 97L and 97R (i.e., open-ended in the LD direction) and has a central wrap portion 91 (extending between the side edges 97L and 97R) that forms a continuous loop in the HD and WD directions for holding the opposing front and rear wings 32F, 32R in the closed position over the apples 2 held in the central base tray 12. The central wrap portion 91 of the sleeve has an outer surface 92 (extending in the loop direction), with a substantially flat planar top label area 93 that resides in or adjacent to the TRP, for displaying advertising or branding, and a bottom substantially flat or planar bottom surface 94 that resides in or adjacent to the BRP.

More specifically, the central closed loop 91 of the sleeve holds the two opposing wings or flaps 32F, 32R of the base tray 10, in a semi-closed closed position over the fruit articles (apples 2) disposed in the recesses or cells 20 in the base tray 12, while providing a central top open portion 43 between the front and rear closed wings 32F, 32R through which the fruit articles (apples 2) are visible and can be viewed (e.g., while in a store display). The open portion 43 also allows for ventilation of the fruit, allowing water vapor or condensation to evaporate and preventing the pulp tray 10 from becoming soft (less rigid).

FIGS. 7-14 show the winged base tray 10 alone, prior to filling with apples, to illustrate the various components of the base tray prior to filling with apples. The filled base tray 10 is illustrated in FIGS. 2-6, prior to applying the sleeve 90. These various figures show the following functional components and operation (movement) of the winged base tray between the open and closed positions as described below.

Figure 7:
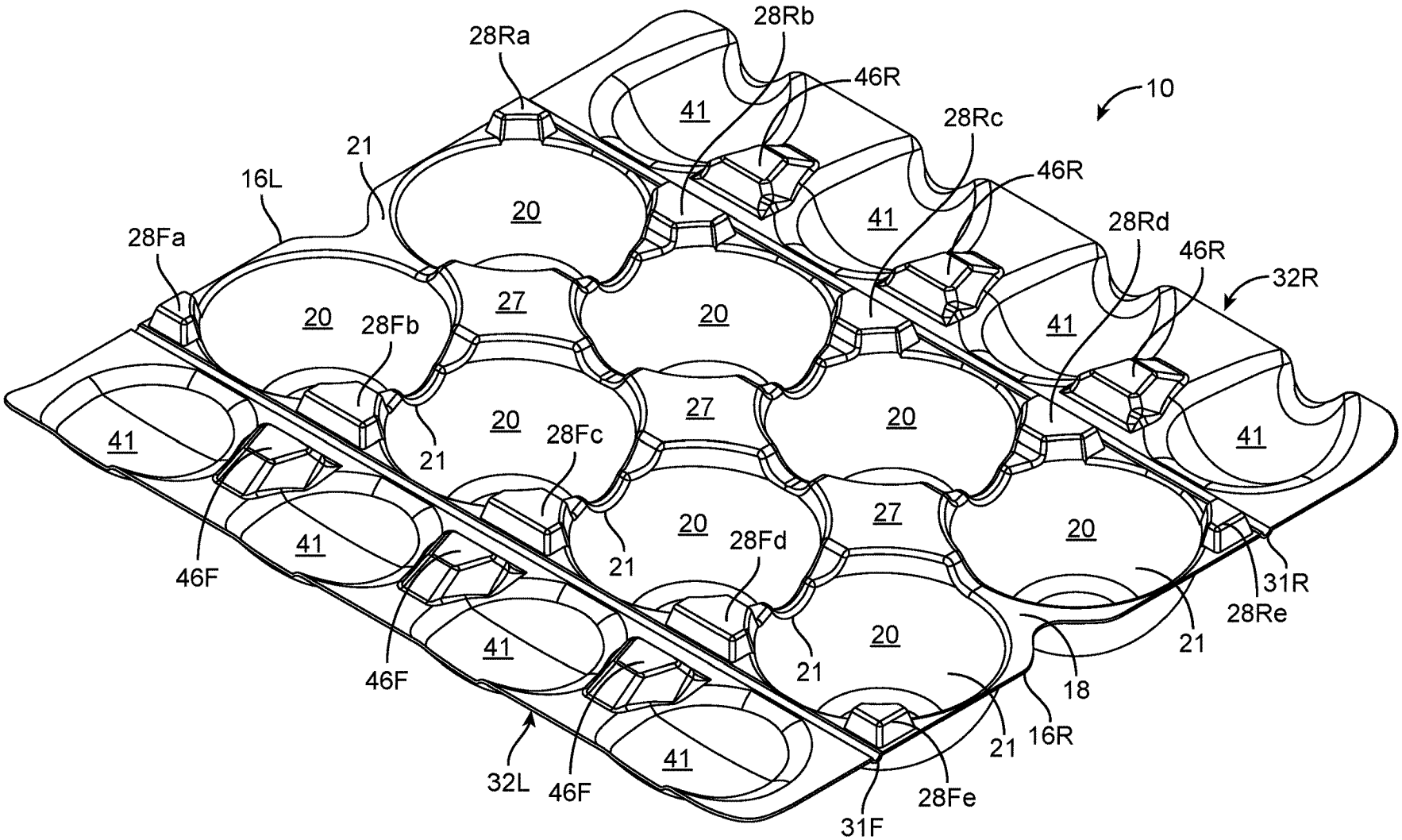
FIG. 7 is a top perspective view of the embodiment of FIG. 1, with tray unfilled in the open position and without the sleeve.
Figure 8:
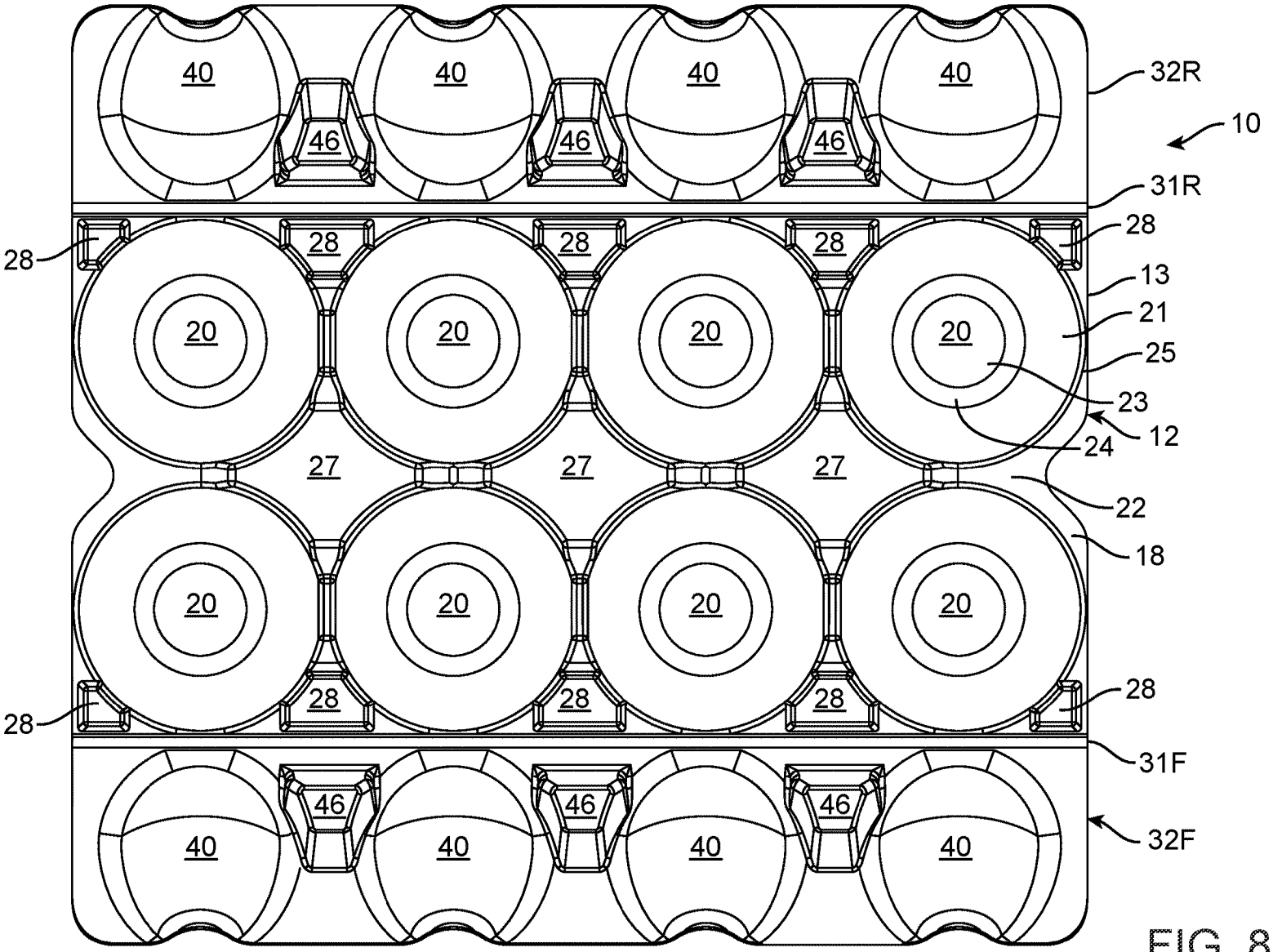
FIG. 8 is a top plan view of the embodiment of FIG. 1, with tray unfilled in the open position and without the sleeve.

The open unfilled base tray as shown in FIG. 7, has a rectangular outer top wall perimeter 13 lying in the TRP, and a bottom wall lying in the BRP. The top wall perimeter encloses both a central area 12 of the base tray with eight (8) individual cells (recesses) 20 formed in the tray which extend downwardly in the H direction from a top wall 13 (surrounding each recess 20) lying in the TRP, to a bottom wall 23 lying in the BRP. The central area 12 of the base tray has opposing front and rear edges 14F, 14R, that are respectively connected by hinge members 31F, 31R to respective front and rear wing portions 32F, 32R. The central base tray 12 and winged portions 32F, 32R each have mating cells 20, 40 that together form a rectilinear array of 8 cell pockets, for holding each of 8 apples in an individual cell pocket when the wings 32F, 32R are positioned over the central area 12 of the base tray in the closed position.

More specifically, each base cell 20 has an outwardly bowed sidewall portion 21, an open top end 25, and closed bottom wall 23. The sidewall is configured (in size and shape) to engage the outer circumference of an apple. The front and rear winged portions 32F, 32R each include a cover portion 41 that is shaped to engage an outer upper surface of the apple, while leaving a central top area 43 over the base tray open (for viewing the apples held between the base tray and winged cover portions). FIGS. 7-8, 12 and 14 show the central area 12 of the base tray and the adjacent front and rear cover portions (wings) 32F, 32R in the open position, with the tops walls 38 of each wing 32F, 32R lying in the TRP. In this open position, multiple winged base trays can be stacked by nesting the central base cells 20 and cover cell portions 41 into the cells of an adjacent (disposed above or below) tray; they can be easily de-nested as well. Further, the tray itself is easy to manufacture, as it can be molded from pulp material in a single mold that defines the respective contours of both the central base area 12 and opposing front and rear cover portions (wings) 32F, 32R of the base tray. The front and rear hinged connections 31F, 31R between the central area and wings are formed at the same time (during molding in a single molding step), again simplifying and reducing the cost of manufacture.

FIGS. 9-11 and 13 show the unfilled base tray 10, now in the closed position with the wings 32F, 32R semi-closed over the central base tray 12, while leaving a central area open 43 for viewing the apples. These figures show the mating cell posts or flanges adjacent the front and rear edges 14F, 14R of the base tray and wings, that engage in the closed position.

More specifically, the central base tray 12 has a rectilinear array of 8 cell recesses 20, each surrounded by the top base wall 18, with adjoining portions of the top wall 18 between the cell sidewalls 21 providing areas of separation to hold a fruit article in each cell spaced from those in adjacent cells. The adjoining wall portions 22 thus act as cell dividers, and may include recessed areas in the divider wall for ease of packing and/or unpacking of the apples from the base tray. The lengthwise centerline LCL of the base tray central area also has a linear array of three raised support posts 27 lying above the TRP that provide further rigidity and support to the base tray structure. Adjacent each of the front and rear edges 14F, 14R of the central base area 12 are a set (linear array) of five spaced-apart cell posts 28F (5 each, labeled 28Fa, b, c, d, e) and 28R (5 each, labeled 28Ra, b, c, d, e) respectively; the three central cell posts of each set 28Fb, 28Fc, 28Fd and 28Rb, 28Rc, 28Rd, each mate a complementary one of three cell posts 46F and 46R sets on the opposing wings (also in a linear array adjacent the front and rear edges respectively), to provide structural support, especially for stacking multiple closed cartons one atop another. The mating cell posts 28, 46 have raised sidewalls that support a planar top wall, for engaging a planar top wall of the mating cell post. Note the mating top walls of may be positioned in a plane parallel to the TRP (as shown in FIGS. 6 and 13), or they may be disposed at an angle to the TRP.

Figure 15:
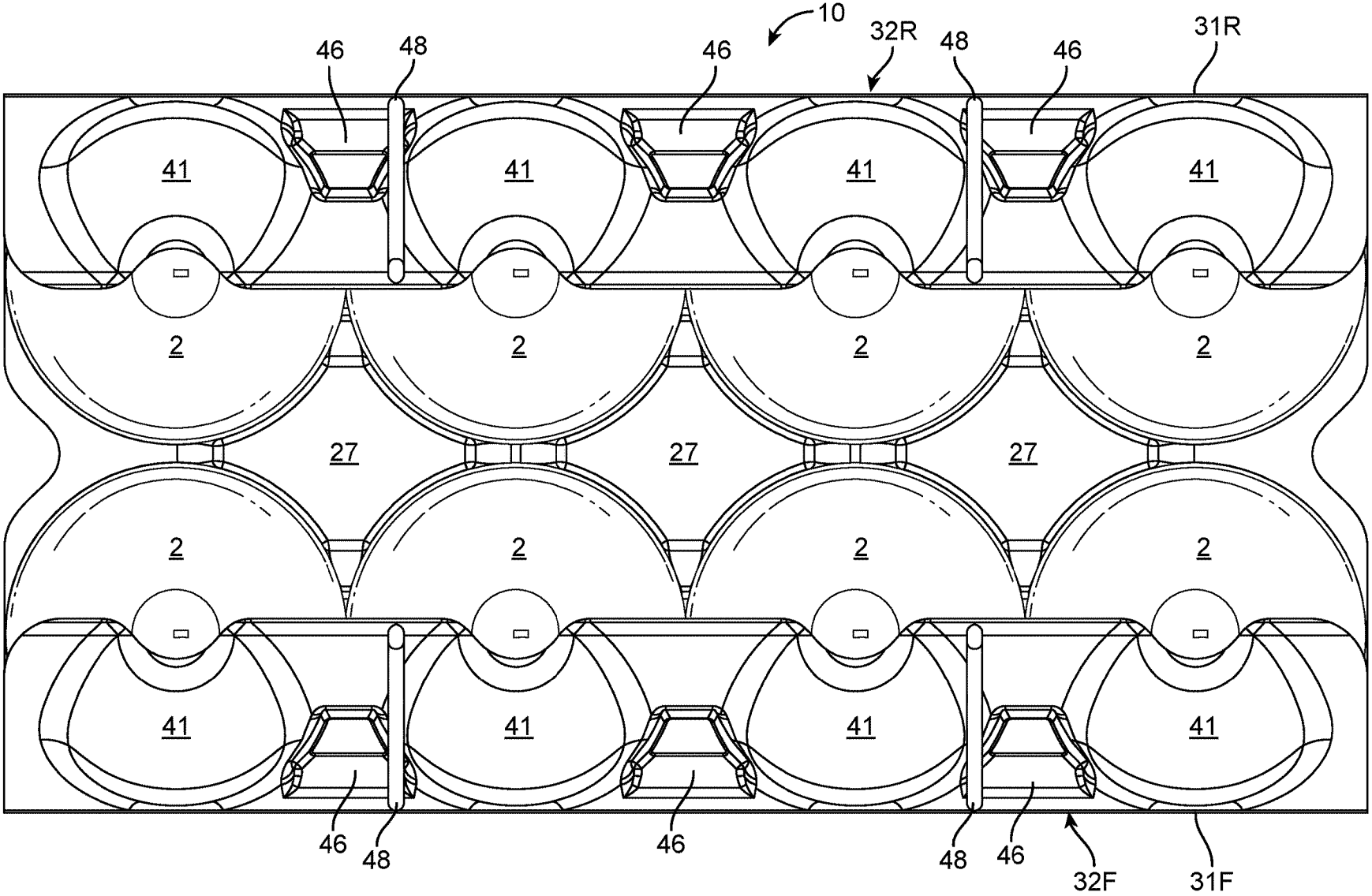
FIG. 15 is a top plan view of another embodiment similar to that of FIGS. 1-14, with the filled tray in the closed position and without the sleeve, further including transverse flanges on the winged tray to assist in holding the sleeve on the closed tray.

FIG. 15 is a top plan view of another embodiment, similar to that of FIGS. 1-14, with the filled tray in the closed position and without the sleeve, further including two sets of transverse flanges 48F and 48R provided on the front and rear winged cover portions 32F, 32R of the winged tray to assist in holding the sleeve on the winged tray in the filled and closed position. The flanges are shown in this one embodiment as outwardly extending molded ribs in each of the wings, lying transverse to the longitudinal centerline LCL of the tray. The configuration and shape of the flanges may vary but are configured to help prevent the sleeve from sliding off the semi-closed winged tray.

In various embodiments, the winged tray is an integral molded fiber article. The molded fiber process draws liquid paper pulp against a mold under vacuum, where it is dewatered and consolidated into a solid article, and the article is then dried into a finished product.

Numerous modifications, including adjustments to the configuration and shape of the winged base tray and outer sleeve to accommodate differently shaped food articles, and/or food articles of different weights or compositions, will be apparent to those skilled in the art and such suitable modifications fall within the scope of the invention as claimed.

The invention claimed is:

1. A combination winged tray and outer sleeve for packaging and displaying a plurality of individual food articles, such as apples, comprising:

the winged tray comprising an integral molded fiber article having a central base tray and a pair of opposing winged cover portions integral with and hingedly connected to opposing front and rear edges of the central base tray for pivoting between open and closed positions over the central base tray, the central base tray and winged cover portions each having a complimentary array of base cells and cover cells respectively that together form an array of semi-closed cell pockets for holding individual food articles in each semi-closed cell pocket when the winged cover portions are closed over the central base tray;

each cell of the opposing winged cover portions having a closed outer wall portion adjacent one of the front and rear edges of the central base tray for partially covering a food article in one of the semi-closed cell pockets, and an open central portion that lies between the opposing winged cover portions in the closed position for displaying food articles in the semi-closed cell pockets, mating base and cover cell posts on the central base tray and winged cover portions respectively disposed adjacent the front and rear edges of the central base tray, and disposed between adjacent semi-closed cell pockets, for supporting the winged cover portions on the central base tray in the closed position, and the outer sleeve comprising an open-ended sleeve having a closed central loop portion configured to engage around a plurality of the semi-closed cell pockets for holding the winged cover portions on the central base tray in the closed position and for displaying the food articles in the semi-closed closed cell pockets.

2. The winged tray and sleeve of claim 1, wherein:

the front and rear edges of the base tray are disposed parallel to a longitudinal centerline of the winged tray, and the open central portion lies above the longitudinal centerline.

3. The winged tray and sleeve of claim 2, wherein:

transverse flanges are provided on the winged cover portions for holding the outer sleeve on the winged tray in the closed position.

4. The winged tray and sleeve of claim 1, wherein:

the sleeve is made of paper, pulp, plastic or cardboard material.

5. The winged tray and sleeve of claim 1, wherein:

the closed central loop portion of the sleeve has a flat label area configured to lie above the central base tray and winged cover portions in the closed position.

6. The winged tray and sleeve of claim 2, wherein:

the closed central loop portion of the sleeve has a length aligned with the longitudinal centerline configured to cover only a portion of the semi-closed cell pockets adjacent the front and rear edges.

7. The winged tray and sleeve of claim 1, wherein:

the central base tray and winged cover portions have opposing right and left side edges, extending between the front and rear edges.

8. The winged tray and sleeve of claim 1, wherein:

each base cell has an outwardly bowed sidewall portion sized to receive a major cell diameter of a food article disposed in the base cell.

9. The winged tray and sleeve of claim 8, wherein:

the sidewall portions of two adjacent base cells form a cell divider which prevents contact between food articles in the adjacent cells.

10. The winged tray and sleeve of claim 1, wherein:

the central base tray has a top wall that lies in a top reference plane TRP and defines an open top end of each base cell, and the base cell posts extend above the TRP.

11. The winged tray and sleeve of claim 10, wherein:

the cell posts of the base tray include front and rear edge base cell posts disposed adjacent the front and read edges respectively and each having an upper support wall disposed above the TRP, and the cell posts of the winged cover portions include front and rear edge cover cell posts disposed adjacent the front and rear edges respectively with mating surfaces for engaging the upper support wall of the front and rear edge base cell posts.

12. The winged tray and sleeve of claim 2, wherein:

the base tray includes a plurality of supporting posts disposed along the longitudinal centerline.

13. The winged tray and sleeve of claim 1, wherein:

the food articles comprise one or more of apples, oranges, grapefruits, guavas, kiwis, peaches, pears, Asian pears, avocados, tomatoes, lemons and limes.

* * * * *